US005235295A

United States Patent [19]

Barbaste et al.

[11] Patent Number: 5,235,295

[45] Date of Patent: Aug. 10, 1993

[54] MICROWAVE EQUALIZER SUITABLE FOR AEROSPACE APPLICATIONS

[75] Inventors: Régis Barbaste, Portet; Joël Larroque, Montrabe; Albert Cerro, Ramonville St Agne; Florence Labarre, Versailles, all of France

[73] Assignee: Alcatel Espace, Courbevoie, France

[21] Appl. No.: 774,245

[22] Filed: Oct. 10, 1991

[30] Foreign Application Priority Data

Oct. 10, 1990 [FR] France ..... 90 12496

[51] Int. Cl.[5] ..... H01P 1/20

[52] U.S. Cl. ..... 333/28 R; 333/116

[58] Field of Search ..... 333/109, 116, 28 R, 333/113, 115

[56] References Cited

U.S. PATENT DOCUMENTS

| | | | |
|---|---|---|---|
| 2,562,281 | 7/1951 | Mumford | 333/115 X |
| 3,382,465 | 5/1968 | Robbins . | |
| 3,593,225 | 7/1971 | Fisher . | |
| 4,013,981 | 3/1977 | Shintani et al. | 333/28 R |
| 4,216,445 | 8/1980 | Abajian | 333/109 X |

FOREIGN PATENT DOCUMENTS

| | | | |
|---|---|---|---|
| 2516328 | 10/1976 | Fed. Rep. of Germany . | |
| 2734436 | 2/1979 | Fed. Rep. of Germany . | |
| 147450 | 12/1978 | Japan | 333/115 |
| 55-75301 | 6/1988 | Japan . | |
| 236701 | 9/1989 | Japan | 333/28 R |

OTHER PUBLICATIONS

1985 IEEE-MIT-S Int'l Microwave Symposium Digest; Jun. 4-6, 1985, St. Louis, Mo.; IEEE, N.Y., 1985; M. Mehdizadeh et al. "High Speed Varactor Tuned Notch Filer", pp. 531-534.

Microwave Journal, vol. 29, No. 10, Oct. 1986, pp. 133-139; G. C. Dipiazza et al. "50 W CW Diode-Tuned UHF Filter".

Electronics Letters, vol. 25, No. 18, Aug. 31, 1989, Stevenage, GB., pp. 1228-1229; C. Y. Chang, et al "Narrow Band Planar Microwave Active Filter".

*Primary Examiner*—Paul Gensler

*Attorney, Agent, or Firm*—Sughrue, Mion, Zinn, Macpeak & Seas

[57] ABSTRACT

A microwave equalizer is used in aerospace applications to correct the gain/frequency response of a microwave system, in particular in a given range of temperatures. To obtain a variation opposite to that of the microwave system by introducing absorption at the operating frequency, it comprises at least one microwave coupler one branch of which has an active device fitted at each of its two ends so that variation in the device parameters enables displacement of the absorption frequency and optionally power. The coupler(s) are coupled to a transmission line of the system and a control circuit.

5 Claims, 3 Drawing Sheets

MICROWAVE EQUALIZER SUITABLE FOR AEROSPACE APPLICATIONS

BACKGROUND OF THE INVENTION

1. Field of the Invention

The present invention concerns a microwave equalizer suitable for use in aerospace applications to correct the gain/frequency response of a microwave system, for example over a particular range of temperatures.

2. Description of the Prior Art

In prior art devices the microwave receiver, especially one for aerospace applications, comprises a set of cascaded modules (mixers, amplifiers, filters, etc). The gain/frequency response of each module tends to vary with temperature. The overall variation is therefore the sum of the various component variations. At present each module is optimized in such a way as to minimize the overall variation, but this is not adequate in all cases. Also, such optimization is very time consuming.

An object of the present invention is to alleviate these drawbacks.

SUMMARY OF THE INVENTION

The present invention consists in a microwave equalizer suitable for use in aerospace applications to correct the gain/frequency response of a microwave system, in particular in a given range of temperatures, wherein to obtain a variation opposite to that of the microwave system by introducing absorption at the operating frequency it comprises at least one microwave coupler of which one branch has an active device at each of its two ends so that variation in the device parameters enables displacement of the absorption frequency and optionally power coupled to a transmission line of said system and a control circuit.

A device of this kind can be used to minimize sufficiently the overall variation in the system parameters. The optimization of the basic modules is therefore less critical, which saves time when setting up the microwave system. A device of this kind also makes it possible to improve the temperature performance of the system whilst reducing the need for adjustment.

The features and advantages of the invention will emerge from the following description given by way of non-limiting example with reference to the appended drawings.

DETAILED DESCRIPTION OF THE INVENTION

Figure 1A:
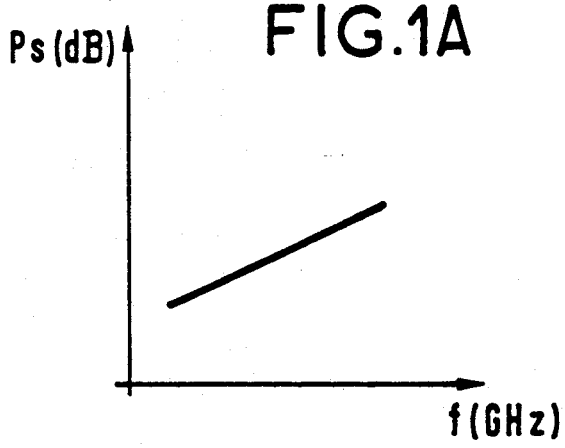
FIGS. 1A–1C are diagrams to illustrate the aim of a device in accordance with the invention.
Figure 1B:
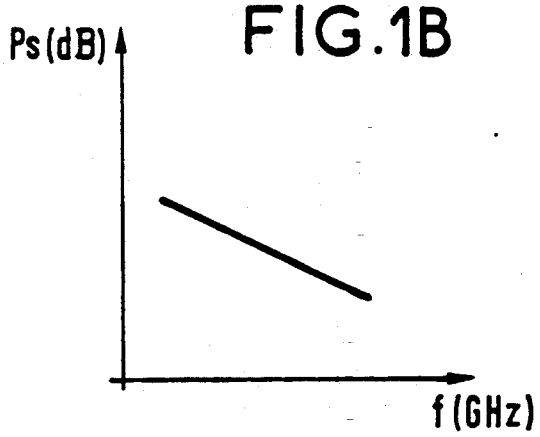
Figure 1C:
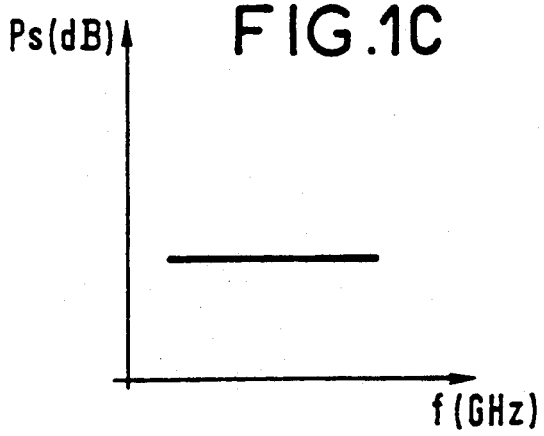

Referring to FIGS. 1A–1C, the aim of the invention is to insert into a microwave system an equalizer for correcting the overall system variation (1A) by providing the mirror-image function (1B) to yield the corrected result (1C). The three curves shown in FIG. 1 plot the variation in the output power Ps as a function of the frequency f.

Figure 2:
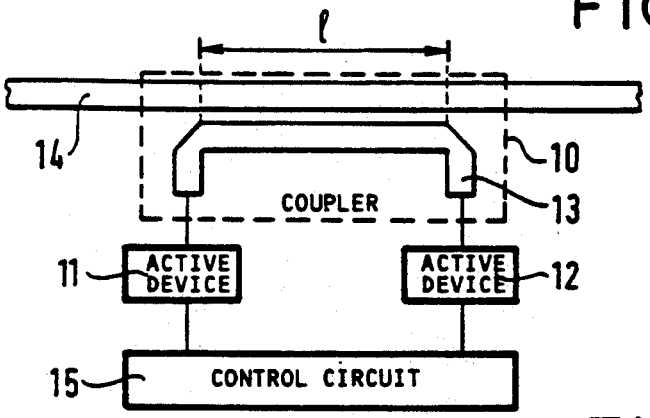
FIG. 2 shows a device in accordance with the invention.

Referring to FIG. 2, this device in accordance with the invention comprises a microwave coupler 10 associated with at least one, in this example two active elements 11 and 12 connected in series with the branch 13 of the coupler 10 which is coupled to the transmission line 14 and a control circuit 15. The coupler 10 is a $\lambda/4$ coupler such that the coupling length l is equal to one quarter the wavelength $\lambda$ of the signal carried on the line 14.

The two active devices 11 and 12 are variable capacitance diodes or PIN diodes, for example, respectively controlled by a voltage or a current:

varying the junction capacitance of a variable capacitance diode shifts the absorption frequency;

varying the junction resistance of a PIN diode varies the frequency and the absorption power.

This device in accordance with the invention is used to generate absorption losses in a required frequency range so that the slope changes sign but remains relatively linear. The total length of the coupled branch makes it possible to achieve absorption at the required frequency. Varying the microwave parameters of the active devices shifts the absorption frequency and power; the absorption is relatively low to ensure good linearity.

This device in accordance with the invention is used to vary the slope as a function of temperature by automatic conditioning of the control signal from the circuit 15 using a thermistor, for example. The control circuit 15 supplies to the active devices 11 and 12 a control voltage or current conditioned by the temperature sensed by the thermistor.

Figure 3:
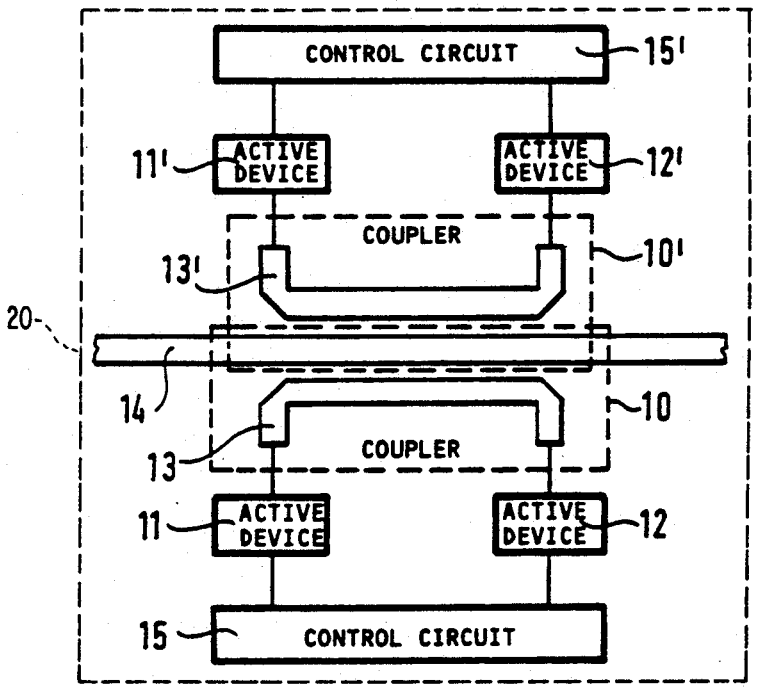
FIGS. 3 and 4 show an alternative embodiment of a device in accordance with the invention.
Figure 4:
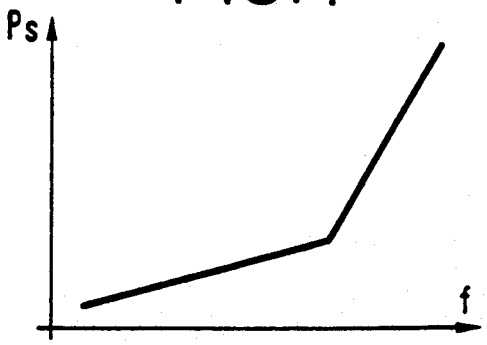

In a different embodiment of a device in accordance with the invention a coupler 10 (10') associated with the active devices 11, 12 (11', 12') and the control circuit 15 (15') is provided on each side of the transmission line 14, as shown in FIG. 3, to obtain double equalization as shown in FIG. 4.

Figure 5:
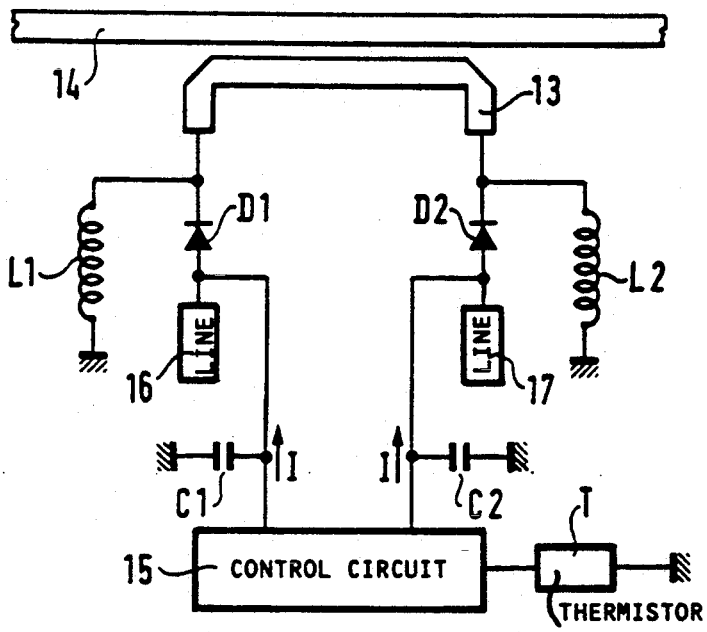
FIGS. 5 and 6 show a further embodiment of a device in accordance with the invention.

In one specific implementation, a device in accordance with the invention forms an equalizer for a 6–4 GHz receiver using two PIN diodes as shown in FIG. 5. The two diodes D1 and D1 are the active devices 11 and 12 from FIG. 2. The device further comprises two capacitors C1 and C2 with of 47 pF, for example, disposed between ground and respective output of the control circuit 15 connect to each diode, an open circuit line 16 (17) connected each of these two outputs and a thermistor T supplying to the control circuit 15 information indicative of the temperature.

Figure 6:
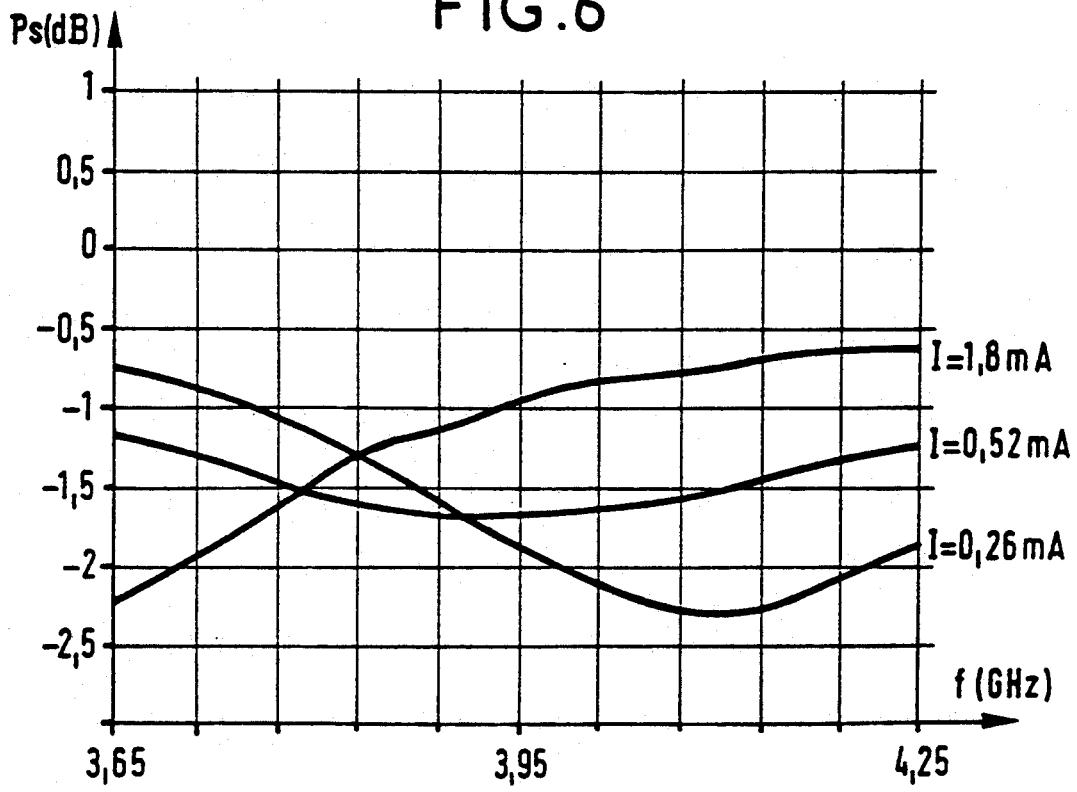

FIG. 6 shows three operating curves for a device of this kind, for different values of the current I in the diodes D1 and D2. Equalization of $\pm 1.5$ dB is obtained at 3.7–4.2 GHz with reflection losses below $-14$ dB. The variation of the in-band linearity is below $\pm 0.5$ dB.

A device in accordance with the invention may be used at other frequencies, however, to form for example:

a 6 GHz equalizer for a 6–4 GHz receiver;

a 12 GHz equalizer for monolithic function receivers.

In this latter case, the device in accordance with the invention is implemented using monolithic technology, e.g., as is schematically shown in FIG. 3 wherein the components are formed on a substrate 20.

This technology can be used to manufacture small devices in large quantities. It may be associated with a design concept using two coupled circuits and four active devices (see FIG. 3 embodiment) with a view to increasing bandwidth and sensitivity.

It is to be understood that the present invention has been described and shown by way of preferred example only and that its component parts can be replaced by equivalent devices without departing from the scope of the invention.

There is claimed:

1. A microwave equalizer suitable for use in a microwave system, said system including a transmission line and having a gain/frequency response, said microwave equalizer correcting the gain/frequency response of said system by introducing absorption at an operating frequency of said system to obtain a variation of said gain/frequency response, said equalizer comprising:

at least one microwave coupler having one branch which has two ends and which is coupled to said transmission line;

a respective active device coupled to each of said ends of said one branch, each said active device having electrical characteristics variable in accordance with control signals applied thereto; and a control circuit for providing said control signals to vary the gain/frequency of said system by displacing a frequency of said absorption;

wherein said gain/frequency response of said system varies as a function of temperature, and wherein said control circuit varies said control signals as a function of temperature to obtain a variation of said gain/frequency response opposite to that of the microwave system.

2. An equalizer according to claim 1, implemented in monolithic technology.

3. An equalizer according to claim 1, wherein said control signals to said active devices varies the power level of said absorption.

4. A microwave equalizer suitable for use in a microwave system, said system including a transmission line and having a gain/frequency response, said microwave equalizer correcting the gain/frequency response of said system by introducing absorption at an operating frequency of said system to obtain a variation of said gain/frequency response, said equalizer comprising:

at least one microwave coupler having one branch which has two ends and which is coupled to said transmission line;

a respective variable capacitance diode coupled to each of said ends of said one branch, each said variable capacitance diode having electrical characteristics variable in accordance with control signals applied thereto; and a control circuit for providing said control signals to vary the gain/frequency of said system by displacing a frequency of said absorption, wherein said microwave coupler has a coupling length with said transmission line equal to one quarter the wavelength of the signal carried by the transmission line.

5. A microwave equalizer suitable for use in a microwave system, said system including a transmission line and having a gain/frequency response, said microwave equalizer correcting the gain/frequency response of said system by introducing absorption at an operating frequency of said system to obtain a variation of said gain/frequency response, said equalizer comprising:

at least one microwave coupler having one branch which has two ends and which is coupled to said transmission line;

a respective active device coupled to each of said ends of said one branch, each said active device having electrical characteristics variable in accordance with control signals applied thereto; and a control circuit for providing said control signals to vary the gain/frequency of said system by displacing a frequency of said absorption, said equalizer further comprising a thermistor connected to said control circuit to provide correction as a function of temperature.

* * * * *